US007642227B2

(12) United States Patent
Kurtz

(10) Patent No.: US 7,642,227 B2
(45) Date of Patent: Jan. 5, 2010

(54) CLEANSING AND DISINFECTING COMPOSITIONS

(75) Inventor: James L. Kurtz, Idaho Falls, ID (US)

(73) Assignee: Melaleuca, Inc., Idaho Falls, ID (US)

( * ) Notice: Subject to any disclaimer, the term of this patent is extended or adjusted under 35 U.S.C. 154(b) by 501 days.

(21) Appl. No.: 11/462,952

(22) Filed: Aug. 7, 2006

(65) Prior Publication Data

US 2008/0032908 A1 Feb. 7, 2008

(51) Int. Cl.
*C11D 17/00* (2006.01)

(52) U.S. Cl. ..... 510/424; 510/463; 510/492; 510/382; 510/383

(58) Field of Classification Search ..... None
See application file for complete search history.

(56) References Cited

U.S. PATENT DOCUMENTS 4,183,952 A 1/1980 Michaels et al.
4,715,980 A 12/1987 Lopes et al.
4,748,279 A 5/1988 Whitely
4,776,974 A 10/1988 Stanton et al.
4,900,721 A 2/1990 Bansemir et al.
4,952,398 A 8/1990 Tapin
5,008,030 A 4/1991 Cook et al.
5,094,843 A 3/1992 Mazzanobile et al.
5,143,720 A 9/1992 Lopes
5,294,431 A 3/1994 Gaffar et al.
5,344,641 A 9/1994 Gaffar et al.
5,356,615 A 10/1994 Gaffar et al.
5,403,587 A 4/1995 McCue et al.
5,437,858 A 8/1995 Hungerbach et al.
5,453,265 A 9/1995 Gaffar et al.
5,460,802 A 10/1995 Asami et al.
5,460,833 A 10/1995 Andrews et al.
5,466,437 A 11/1995 Gaffar et al.
5,490,992 A 2/1996 Andrews et al.
5,538,715 A 7/1996 Gaffar et al.
5,686,064 A 11/1997 Gaffar et al.
5,716,920 A 2/1998 Glenn, Jr. et al.
5,723,106 A 3/1998 Buch et al.
5,750,482 A 5/1998 Cummings
5,830,487 A 11/1998 Klofta et al.
5,891,422 A 4/1999 Pan et al.
5,925,606 A 7/1999 Stamm
5,942,478 A 8/1999 Lopes
5,968,539 A 10/1999 Beerse et al.
6,004,909 A 12/1999 Lindmann
6,010,993 A 1/2000 Romano et al.
6,022,459 A 2/2000 Briggs
6,022,551 A 2/2000 Jampani et al.
6,096,349 A 8/2000 Petri et al.
6,103,683 A 8/2000 Romano et al.
6,106,838 A 8/2000 Nitsas
6,110,888 A 8/2000 Lupo, Jr. et al.
6,113,933 A 9/2000 Beerse et al.
6,114,298 A 9/2000 Petri et al.
6,143,703 A 11/2000 Cheung et al.
6,152,152 A 11/2000 Reynen et al.
6,183,757 B1 2/2001 Beerse et al.
6,190,675 B1 2/2001 Beerse et al.
6,197,315 B1 3/2001 Beerse et al.
6,210,695 B1 4/2001 Beerse et al.
6,214,363 B1 4/2001 Beerse et al.
6,217,887 B1 4/2001 Beerse et al.
6,221,823 B1 4/2001 Crisanti et al.
6,262,038 B1 7/2001 Pierce et al.
6,281,182 B1 8/2001 Leonard et al.
6,322,825 B1 11/2001 Ninkov
6,346,279 B1 2/2002 Rochon
6,346,281 B1 2/2002 DeAth et al.
6,436,342 B1 8/2002 Petri et al.
6,537,955 B1 3/2003 Raso et al.
6,537,957 B1 3/2003 Cardola et al.
6,613,728 B1 9/2003 Sirianni et al.
6,617,290 B2 9/2003 Lopes
6,627,590 B1 9/2003 Sherry et al.
6,696,399 B1 2/2004 Chernin et al.
6,699,825 B2 3/2004 Rees et al.
6,701,940 B2 3/2004 Tsibouklis et al.
6,753,305 B2 6/2004 Raso et al.
6,759,006 B1 7/2004 Siklosi et al.
6,803,057 B2 10/2004 Ramirez et al.
6,812,196 B2 11/2004 Rees et al.
6,814,929 B2 11/2004 Lehoux et al.
6,841,090 B1 1/2005 Serego Alligheri et al.
6,841,572 B2 1/2005 Horst et al.
6,846,498 B2 1/2005 DeAth et al.
6,867,233 B2 3/2005 Roselle et al.
6,953,772 B2 10/2005 Lopes
7,090,882 B2 8/2006 Koefod et al.
7,153,818 B2 * 12/2006 Breves et al. ..... 510/226

* cited by examiner

*Primary Examiner*—Necholus Ogden, Jr.
(74) *Attorney, Agent, or Firm*—Fish & Richardson P.C.

(57) ABSTRACT

Cleansing compositions for cleaning and/or disinfecting surfaces such as hard surfaces are provided.

4 Claims, No Drawings

CLEANSING AND DISINFECTING COMPOSITIONS

BACKGROUND

1. Technical Field

This document relates to methods and materials involved in cleaning, disinfecting, and/or sanitizing surfaces. For example, this document relates to homogeneous, aqueous liquid compositions that can be used as cleaners, sanitizers, and disinfectants for hard surfaces, particularly food contact surfaces.

2. Background Information

There is a need for a high degree of cleanliness in residential kitchens and commercial food preparation and serving areas. These areas are subject to frequent soiling due to food preparation and other everyday activities. The hard surfaces in these areas require frequent and thorough cleaning in order to maintain a high degree of cleanliness.

Food debris and residues are among the most frequently occurring soils found in residential kitchens and commercial food preparation areas. These soils, if not promptly and thoroughly removed by cleaning, can provide a harboring place for microbial growth. Microbial growth in food preparation and food serving areas has been linked to the outbreak of foodborne disease in a number of cases. As a result, there is a high degree of public awareness of the risk of microbial growth in food preparation and food serving areas and the need for sanitizing and disinfecting products for use in such areas.

SUMMARY

This document provides methods and materials related to cleaning and/or disinfecting surfaces. For example, this document provides cleansing compositions that can be used to clean and/or disinfect surfaces such as hard surfaces. This document also provides methods for cleaning and/or disinfecting hard surfaces such as food contact surfaces. The cleansing compositions provided herein can be used to clean and/or disinfect surfaces safely and effectively.

There is a public awareness of the risks posed by the presence of traces of pesticide chemicals in food. The use of disinfectant or sanitizer products in food preparation and serving areas can be associated with a risk of residues of active and inert ingredients being ingested along with food. Such an ingredient, although permitted, can be chemically reactive or subject to ongoing toxicological review. In addition, public skepticism can exist regarding the safety of products containing certain chemicals, or chemicals in general. This document provides efficacious cleansers, sanitizers, and disinfectants that minimize risks associated with residues thereof and also have a suitable shelf life.

This document is based, in part, on the discovery that homogeneous, aqueous acidic compositions containing alkyl sulfates and prepared as described herein can remain homogeneous during storage. For example, this document is based, in part, on the discovery that the instability of alkyl sulfates toward hydrolysis can be adequately controlled by incorporating a sufficient quantity of salts of a weak acid (e.g., trisodium citrate dihydrate) into the cleansing composition. This document also is based, in part, on the discovery that the physical instability due to stratification of disinfectant concentrate can be prevented or controlled by incorporating a sufficient quantity of a phenolic compound, e.g., thymol.

Homogeneous, aqueous acidic compositions that contain an alkyl sulfate and are prepared as described herein can remain homogeneous for at least one year when stored at ambient temperature. Such compositions may be employed as ready-to-use (RTU) disinfecting, cleansing, and/or sanitizing solutions. Such compositions may also be employed as dilutable liquids that, when diluted with water, yield disinfecting, cleansing, and/or sanitizing solutions.

In some cases, the cleansing compositions provided herein are stable and effective cleansing compositions that can be safe for use in cleaning and/or disinfecting surfaces that come in contact with food or humans or animals. For example, the cleansing compositions provided herein can be used to clean or disinfect food contact surfaces. In some cases, the cleansing compositions provided herein can be used to clean or disinfect eating utensils (e.g., forks, spoons, and knives) and food preparation utensils and surfaces (e.g., cutting boards, pots, pans, skillets, etc.). Typically, the cleansing compositions provided herein are not intended for regular or prolonged use directly on human skin since such use can be too harsh to human skin.

In general, one aspect of this document features a cleansing composition comprising, or consisting essentially of, sodium lauryl sulfate, citric acid, ammonium hydroxide, and thyme oil, where between 6 and 7 percent by weight (or between 1.5 and 2.5 percent on an active basis) of the composition comprises the sodium lauryl sulfate, where between 3 and 5 percent of the composition comprises the citric acid by weight, where between 0.7 and 0.8 percent of the composition comprises the ammonium hydroxide by weight, and where between 0.3 and 0.5 percent of the composition comprises the thyme oil by weight.

In another aspect, this document features a cleansing composition comprising, or consisting essentially of, sodium lauryl sulfate, citric acid, ammonium hydroxide, and thyme oil, where between 3 and 3.5 percent by weight (or between 0.75 and 1.25 percent on an active basis) of the composition comprises the sodium lauryl sulfate, where between 1.5 and 2.5 percent of the composition comprises the citric acid by weight, where between 0.35 and 0.4 percent of the composition comprises the ammonium hydroxide by weight, and where between 0.075 and 0.125 percent of the composition comprises the thyme oil by weight.

In another aspect, this document features a cleansing composition comprising, or consisting essentially of, sodium lauryl sulfate, citric acid, trisodium citrate dihydrate, and thymol, where between 5 and 7 percent of the composition comprises the sodium lauryl sulfate by weight, where between 9 and 10 percent of the composition comprises the citric acid by weight, where between 4 and 5 percent of the composition comprises the trisodium citrate dihydrate by weight, and where between 0.5 and 1 percent of the composition comprises the thymol by weight.

In another aspect, this document features a cleansing composition comprising, or consisting essentially of, sodium lauryl sulfate, citric acid, trisodium citrate dihydrate, and thymol, where between 0.8 and 1.2 percent of the composition comprises the sodium lauryl sulfate by weight, where between 1 and 2 percent of the composition comprises the citric acid by weight, where between 0.5 to 0.7 percent of the composition comprises the trisodium citrate dihydrate by weight, and where between 0.04 to 0.06 percent of the composition comprises the thymol by weight.

In another aspect, this document features a cleansing composition comprising, or consisting essentially of: (a) from 0.5 percent to 10 percent of at least one alkyl sulfate; (b) from 1 percent to 20 percent of at least one carboxylic acid selected from the group consisting of citric acid, malic acid, lactic acid, and tartaric acid; (c) at least one buffering agent selected from the group consisting of ammonium hydroxide, magnesium oxide, sodium hydroxide, and magnesium salts of carboxylic acids; and (d) from 10 percent to 99 percent water; where the ratio of the total number of equivalents of unneutralized weak acid to the total number of equivalents of buffering agent cations is in the ratio of from 10 to 1 to 1 to 1 (e.g., 9:1 to 2:1), where the ratio of the total number of equivalents of buffering agent cations to the total number of equivalents of alkyl sulfate is at least 1 to 1, and where the composition is a homogeneous solution that remains homogeneous for a period of at least 12 months when stored at 20° C. or for a period of at least three months when stored at 40° C. The composition can comprise a phenolic compound selected from the group consisting of thymol, carvacrol, natural oils containing thymol, and natural oils containing carvacrol. The ratio of the total number of equivalents of unneutralized weak acid to the total number of equivalents of buffering agent cations can be about 4 to 1.

Unless otherwise defined, all technical and scientific terms used herein have the same meaning as commonly understood by one of ordinary skill in the art to which this invention pertains. Although methods and materials similar or equivalent to those described herein can be used to practice the invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments of the invention are set forth in the accompanying drawings and the description below. Other features, objects, and advantages of the invention will be apparent from the description and drawings, and from the claims.

DETAILED DESCRIPTION

This document provides methods and materials related to cleaning and/or disinfecting surfaces. For example, this document provides cleansing compositions that can be used to clean or disinfect surfaces such as hard surfaces (e.g., food contact surfaces). This document also provides methods for cleaning or disinfecting surfaces such as hard surfaces.

The cleansing compositions provided herein can be used to clean or disinfect any type of surface such as a hard surface. Examples of hard surfaces include, without limitation, food contact surfaces (e.g., eating utensils, sinks, stovetops, countertops, tabletops, and cutting boards), children's toys, surfaces associated with day cares and nurseries (e.g., cribs, high chairs, etc.), lavatory fixtures and appliances (e.g., toilets, shower stalls, bathtubs, and bathing appliances), wall and flooring surfaces, surfaces associated with hospital environments, medical laboratories, and medical treatment environments (e.g., laboratory glass ware, medical testing equipment, and bedpans).

The cleansing compositions provided herein can be used in a consumer "spray and wipe" application. For example, a consumer can apply an effective amount of a cleansing composition provided herein to a hard surface using, e.g., a pump and within a few moments thereafter, wipe off the treated area with a rag, towel, or sponge. In some cases, especially where thorough disinfection of a hard surface is desired, a cleansing composition provided herein can be left on the hard surface for, e.g., one, two, three, four, five, or more minutes (e.g., 10, 15, 20, 25, or 30 minutes), or can be allowed to air dry. In some cases, the surface can be rinsed following application of the cleansing composition. For example, food contact surfaces and surfaces that come into direct skin and oral contact can be rinsed with potable water following application of a cleansing composition provided herein.

The cleansing compositions provided herein can also be used to produce wipes, such as ready-to-use wipes. For example, the cleansing compositions provided herein can be used to impregnate wipes, which can be packaged in a sealable container, such as a plastic container that allows the wipes to be removed, e.g., one wipe at a time. The wipes can be separate or attached to one another so as to form a continuous roll or stack. Wipes can be attached to each other by any means, such as by perforations allowing easy separation of one wipe from the next.

The cleansing compositions provided herein can be ready-to-use cleansing compositions or can be concentrated cleansing compositions. A ready-to-use cleansing composition is any cleansing composition that contains active ingredients at a concentration suitable for typical cleaning or disinfecting use. A concentrated cleansing composition is any cleansing composition that contains active ingredients at a concentration that is typically diluted before being used to clean or disinfect a surface. A concentrated cleansing composition provided herein can be a 2×, 3×, 4×, 5×, 6×, 7×, 8×, 9×, 10×, or greater concentrated cleansing composition. The concentrations of the ingredients (e.g., active ingredients) in a concentrated cleansing composition can be decreased to provide a ready-to-use cleansing composition by diluting the concentrations of the ingredients through, for example, the addition of water. For example, a 6× concentrated cleansing composition can be diluted to a 1× ready-to-use cleansing composition by adding five volumes of water to the 6× concentrated cleansing composition.

A cleansing composition provided herein can contain a weak acid (e.g., a carboxylic acid), an alkyl sulfate, a buffering agent, and water. In some cases, a cleansing composition provided herein can also contain one or more phenolic compounds. Examples of a weak acid include, without limitation, citric acid, tartaric acid, malic acid, lactic acid, and combinations thereof. A cleansing composition provided herein can contain from about 0.1 to about 30 percent weak acid (e.g., about 0.1, 0.5, 1, 5, 10, 15, 20, 25, or 30 percent), by weight. For example, a ready-to-use cleansing composition provided herein can contain from about 0.75 to about 5 percent weak acid (e.g., about 0.75, 1, 1.5, 2, 2.5, 3, 3.5, 4, 4.5, or 5 percent), by weight. In some cases, 2 percent of a ready-to-use cleaning composition can be weak acid. A concentrated cleansing composition provided herein can contain a higher concentration of weak acid, by weight. For example, a 2×, 3×, 4×, and so on concentrated cleansing composition can contain 2, 3, 4, and so on times more of a weak acid. In some cases, a 6× concentrated cleansing composition provided herein can contain from about 5 to about 25 percent weak acid (e.g., about 5, 6, 7, 8, 9, 10, 11, 12, 13, 14, 15, 16, 17, 18, 19, 20, 21, 22, 23, 24, or 25 percent), by weight. For example, 6 to 20 percent of a 6× concentrated cleaning composition can be a weak acid (e.g., citric acid), by weight. In some cases, a 2× concentrated cleansing composition provided herein can contain from about 2 to 8 percent weak acid (e.g., about 2, 3, 4, 5, 6, 7, or 8 percent), by weight. For example, 3 to 5 percent by weight of a 2× concentrated cleaning composition can be a weak acid.

Examples of alkyl sulfates include, without limitation, the sodium, ammonium, and magnesium salts of alkyl sulfates having an average carbon chain length in the range of 8 to 16 carbon atoms, and combinations thereof. Additional examples of alkyl sulfates include, without limitation, the ammonium and sodium salts of lauryl sulfates, coconut alcohol sulfates, and palm kernel alcohol sulfates, and combinations thereof. An alkyl sulfate can contain as little unsulfated alcohol as possible, e.g., no more than about 4 percent unsulfated alcohol based on the total active matter content. In some cases, an alkyl sulfate containing 27 percent sodium lauryl sulfate, as determined by hyamine titration, can contain no more than 1.08 percent unsulfated alcohol.

The amount of alkyl sulfate included in a cleansing composition provided herein can depend on the required dilution volume, the degree of sanitizing and disinfecting efficacy required, and the amount of phenolic compound employed. In general, an increased amount of alkyl sulfate can be required for a greater dilution volume, a greater sanitizing and disinfecting efficacy, and/or a greater amount of phenolic compound(s). A cleansing composition provided herein can contain from about 0.1 to about 15 percent alkyl sulfate (e.g., about 0.1, 0.2, 0.3, 0.4, 0.5, 0.75, 1, 1.25, 1.5, 1.75, 2, 3, 4, 5, 6, 7, 8, 9, 10, 11, 12, 13, 14, or 15 percent), by weight. For example, 0.5 to 5 percent by weight of a ready-to-use cleaning composition can be alkyl sulfate. A concentrated cleansing composition provided herein can contain a higher concentration of an alkyl sulfate, by weight, than a ready-to-use cleansing composition. For example, a 2×, 3×, 4×, and so on concentrated cleansing composition can contain 2, 3, 4, and so on times more of an alkyl sulfate than a ready-to-use composition. In some cases, a 2× concentrated cleansing composition provided herein can contain from about 1 to about 10 percent alkyl sulfate (e.g., about 2, 3, 4, 5, 6, 7, 8, 9 or 10 percent), by weight. For example, 6 to 8 percent by weight of a 2× concentrated cleaning composition can be alkyl sulfate.

Examples of buffering agents include, without limitation, food additive bases such as ammonium hydroxide FCC, sodium hydroxide FCC, and magnesium oxide FCC, and combinations thereof. Additional examples of buffering agents include, without limitation, salts of weak acids described above, such as ammonium, sodium, and magnesium salts of citric acid, malic acid, tartaric acid, and lactic acid, and combinations thereof. Buffering agents used to prepare cleansing compositions as described herein can meet purity criteria for food additives. The amount of buffering agent required for a cleansing composition can depend on the amount of weak acid and the amount of alkyl sulfate in the composition. A cleansing composition can contain an amount of buffering agent that results in an initial ratio of the number of mole equivalents of unneutralized weak acid to the number of mole equivalents of neutralized weak acid anions in the range of about 10 to 1 to about 1 to 1. The ratio can be adjusted based on the desired sanitizing or disinfecting effectiveness and/or the desired physical stability or shelf life of the composition. A greater ratio, e.g., greater than 5 to 1, such as 6 to 1, 7 to 1, 8 to 1, 9 to 1 or 10 to 1, can increase the sanitizing or disinfecting effectiveness of the composition as compared to a composition have a lower ratio, e.g., 4 to 1, 3 to 1, 2 to 1, or 1 to 1. A lower ratio, e.g., lower than 5 to 1, such as 4 to 1, 3 to 1, 2 to 1, or 1 to 1, can increase the physical stability and shelf life of the composition as compared to a composition having a greater ratio, e.g., 6 to 1, 7 to 1, 8 to 1, 9 to 1 or 10 to 1. In some cases, a cleansing composition can contain an amount of buffering agent that results in a ratio of the total number of equivalents of unneutralized weak acid to the total number of equivalents of buffering agent cations, e.g., sodium, in the range of about 10 to 1 to about 2 to 1 (e.g., about 10 to 1, 9 to 1, 8 to 1, 7 to 1, 6 to 1, 5 to 1, 4 to 1, 3 to 1, or 2 to 1), where the ratio of the total number of equivalents of buffering agent cations to the total number of equivalents of alkyl sulfate is at least 1 to 1. The total number of equivalents of weak acid anion, e.g., carboxylate, can be from both weak acid, e.g., carboxylic acid, and weak acid salt, e.g., carboxylic acid salt.

In some cases, an amount of buffering agent included in a cleansing composition can be expressed as a percentage by weight. The percentage by weight of a buffering agent can vary in proportion to the amount of weak acid as a percentage by weight, the equivalent weight of the weak acid, and the equivalent weight of the buffering agent. In some cases, a ready-to-use cleansing composition containing about 1 percent weak acid, e.g., citric acid, can contain from about 0.01 to about 0.2 percent (e.g., about 0.01, 0.02, 0.03, 0.035, 0.04, 0.045, 0.05, 0.055, 0.06, 0.065, 0.07, 0.075, 0.08, 0.085, 0.09, 0.095, 0.1, 0.105, 0.11, 0.115, 0.12, 0.125, 0.13, 0.14, 0.15, 0.16, 0.17, 0.18, 0.19, or 0.2 percent) buffering agent, e.g., ammonia, or about 0.03 to about 0.7 percent (e.g., 0.035, 0.05, 0.1, 0.2, 0.3, 0.4, 0.5, 0.6, or 0.7 percent) by weight buffering agent, e.g., ammonia, when expressed as a percent of a solution of about 29 percent buffering agent, e.g., ammonia, in water. For example, a ready-to-use cleansing composition containing 1 percent citric acid can contain 0.092 to 0.49 percent buffering agent by weight. In some cases, a ready-to-use cleansing composition containing 2 percent citric acid can contain 0.3 to 0.5 percent buffering agent by weight. A concentrated cleansing composition provided herein can contain a higher concentration of a buffering agent, as a percentage by weight. For example, a 2×, 3×, 4×, and so on concentrated cleansing composition can contain 2, 3, 4, and so on times more of a buffering agent. In some cases, a concentrated cleansing composition containing about 16 percent weak acid, e.g., citric acid, by weight can contain from about 1 percent to about 30 percent (e.g., about 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30 percent) of a buffering agent, e.g., trisodium citrate dihydrate, by weight. For example, 2.45 to 24.5 percent by weight of a concentrated cleansing composition containing 16 percent citric acid by weight can be trisodium citrate dihydrate. In some cases, a 2× concentrated cleansing composition containing about 4 percent weak acid, e.g., citric acid, by weight can contain 0.7 to 0.8 percent by weight of a buffering agent, e.g., ammonium hydroxide.

Examples of phenolic compounds include, without limitation, thymol, carvacrol, eugenol, and natural oils containing phenolic compounds, such as thyme oil and clove oil, and combinations thereof. A ready-to-use cleansing composition provided herein can contain from about 0.05 to about 0.5 percent phenolic compound (e.g., about 0.05, 0.07, 0.08, 0.1, 0.2, 0.3, 0.4, or 0.5 percent), by weight. For example, about 0.2 percent of a ready-to-use cleaning composition can be a phenolic compound. In some cases, about 0.1 percent of a ready-to-use cleaning composition can be a phenolic compound. A concentrated cleansing composition provided herein can contain a higher concentration of phenolic compound, by weight. For example, a 2×, 3×, 4×, and so on concentrated cleansing composition can contain 2, 3, 4, and so on times more phenolic compound. In some cases, a 6× concentrated cleansing composition provided herein can contain from about 0.1 to about 1 percent phenolic compound (e.g., about 0.1, 0.5, 0.75, or 1 percent), by weight. For example, 0.5 to 0.7 percent (e.g., 0.6 percent) of a 6× concentrated cleaning composition can be thyme oil, by weight. In some cases, a 2× concentrated cleansing composition provided herein can contain 0.3 to 0.5 percent (e.g., 0.4 percent) by weight of a phenolic compound (e.g., thyme oil). A phenolic compound can be used to increase the antimicrobial efficacy of a cleansing composition, to prevent or minimize sedimentation in the cleansing composition, or for both purposes.

In some embodiments, a cleansing composition provided herein can contain an alkyl sulfate, a weak acid, a salt derived from a weak acid, a phenolic compound, and water. Examples of alkyl sulfates include, without limitation, sodium lauryl sulfate and ammonium lauryl sulfate. A ready-to-use cleansing composition provided herein can contain from about 0.5 to about 2.5 percent alkyl sulfate (e.g., about 0.5, 0.75, 1, 1.25, 1.5, 1.75, or 2 percent), by weight. For example, 1 percent of a ready-to-use cleaning composition can be an alkyl sulfate. A concentrated cleansing composition provided herein can contain a higher concentration of an alkyl sulfate, by weight. For example, a 2×, 3×, 4×, and so on concentrated cleansing composition can contain 2, 3, 4, and so on times more of an alkyl sulfate. In some cases, a 6× concentrated cleansing composition provided herein can contain from about 1 to about 10 percent alkyl sulfate (e.g., about 1, 2, 3, 4, 5, 6, 7, 8, 9 or 10 percent), by weight. For example, 5 to 7 percent of a 6× concentrated cleaning composition can be alkyl sulfate, by weight.

Examples of a weak acid are described above. As also described above, a ready-to-use cleansing composition provided herein can contain from about 0.75 to about 5 percent weak acid (e.g., about 0.75, 1, 1.5, 2, 2.5, 3, 3.5, 4, 4.5, or 5 percent), by weight. For example, 1.6 percent of a ready-to-use cleaning composition can be a weak acid. A concentrated cleansing composition provided herein can contain a higher concentration of a weak acid, by weight. For example, a 2×, 3×, 4×, and so on concentrated cleansing composition can contain 2, 3, 4, and so on times more of a weak acid. In some cases, a 6× concentrated cleansing composition provided herein can contain from about 5 to about 15 percent weak acid (e.g., about 5, 6, 7, 8, 9, 10, 11, 12, 13, 14, or 15 percent), by weight. For example, 9 to 10 percent of a 6× concentrated cleaning composition can be a weak acid (e.g., citric acid), by weight.

Examples of salts of weak acids include, without limitation, sodium citrate, ammonium citrate, sodium malate, sodium lactate, ammonium malate, ammonium lactate, and combinations thereof. A ready-to-use cleansing composition provided herein can contain from about 0.3 to about 1 percent salts of weak acids (e.g., about 0.3, 0.4, 0.5, 0.6, 0.7, 0.8, 0.9, or 1 percent), by weight. For example, about 0.6 percent of a ready-to-use cleaning composition can be salts of weak acids. A concentrated cleansing composition provided herein can contain a higher concentration of salts of weak acids, by weight. For example, a 2×, 3×, 4×, and so on concentrated cleansing composition can contain 2, 3, 4, and so on times more of salts of weak acids. In some cases, a 6× concentrated cleansing composition provided herein can contain from about 2 to about 5 percent salts of weak acids (e.g., about 2, 3, 4, or 5 percent), by weight. For example, 3 to 4 percent (e.g., 3.69 percent) of a 6× concentrated cleaning composition can be a salt of a weak acid (e.g., trisodium citrate dihydrate), by weight. The salt of a weak acid can be used to stabilize the alkyl sulfate from acid hydrolysis. In some embodiments, ammonium citrate can be formed in situ by combining ammonium hydroxide and citric acid. The relative concentrations of weak acids to salts of weak acids can be varied to provide a buffer at varying pH values. Typically, the cleansing compositions provided herein can have a pH such that the buffer remains within a range of about 3.0 to 4.0. To obtain accurate pH measurements, the pH is typically measured in relation to a citric acid/citrate buffer produced by mixing citric acid with trisodium citrate in a specific mole ratio. Ready-to-use compositions provided herein can give direct pH measurements in the range of about 3.0 to 3.5, but there is considerable pH drift when measuring pH in this range so a buffer reference is typically used.

Examples of phenolic compounds are described above, as are amounts of phenolic compounds that can be included in cleansing compositions provided herein.

A cleansing composition provided herein can contain one or more food safe ingredients. Examples of such ingredients include, without limitation, those recognized by the United States Food and Drug Administration as "Generally Recognized as Safe" (GRAS). Typically, a ready-to-use cleansing composition provided herein can contain less than 10 percent by weight of a food safe ingredient. Additional ingredients that can be included in a composition provided herein include, without limitation, natural oils and extracts, flavor and scent additives, solvents, thickeners, and stabilizers.

Water can be included in a cleansing composition provided herein so that the desired concentration of other ingredients is achieved. The water can be substantially free of any undesirable impurities such as organics or inorganics.

The cleansing compositions provided herein can be made using methods known to those skilled in the art. For example, the ingredients can be dissolved in water with agitation. The temperature of the water used to dissolve the ingredients can be between 25° C. and 55° C. (e.g., between 40° C. and 50° C.). The ingredients can be added to the composition in any order. For example, an order that optimizes solubility can be used to make a cleansing composition provided herein. In some cases, alkyl sulfate can be added prior to natural oil to increase the solubility of the natural oil in water.

The cleansing compositions provided herein can have a tolerance to alkyl sulfate hydrolysis of about 4 percent or more (e.g., about 4, 5, 6, 7, 8, 9, or 10 percent or more). The tolerance can be determined as described in Example 3, for example. In addition, the cleansing compositions provided herein can remain homogeneous during storage under different conditions. For example, the cleansing compositions provided herein can remain homogeneous for at least 6 months (e.g., at least 6, 7, 8, 9, 10, 11, 12, 13, 14, 15, 16, 17, 18, 19, 20, 21, 22, 23, or 24 months) when stored at a temperature ranging from about 15° C. to about 25° C. (e.g., about 15, 16, 17, 18, 19, 20, 21, 22, 23, 24, or 25° C.). In some cases, the cleansing compositions provided herein can remain homogeneous for at least about 1 month (e.g., at least about 1, 2, 3, 4, 5, or 6 months) when stored at a temperature in the range of about 35° C. to about 45° C. (e.g., about 35, 36, 37, 38, 39, 40, 41, 42, 43, 44, or 45° C.). In the event that a cleansing composition provided herein, such as a concentrated cleansing composition, becomes physically separated during storage, the composition can be reconstituted. For example, a cleansing composition provided herein that develops an opaque or semisolid layer below a critical temperature can be reconstituted by warming the sample to a temperature above the critical temperature. In some cases, a cleansing composition provided herein that sediments below a critical temperature can be reconstituted by agitating the sample at a temperature above the critical temperature until the sample is reconstituted.

The invention will be further described in the following examples, which do not limit the scope of the invention described in the claims.

EXAMPLES

Example 1

Preparation of a 2× Concentrated Cleansing Composition

A 2× concentrated cleansing composition was made to have the ingredients listed in Table 1. Briefly, water purified by reverse osmosis was weighed into a tared vessel. The water was heated to 50° C. and agitation was started. Citric acid was added and the solution was agitated until the citric acid was dissolved. Ammonia was added, followed by addition of sodium lauryl sulfate. The solution was mixed well after each addition. Thyme oil was added, and mixing was continued until the solution was completely clear.

TABLE 1

A 2X concentrated cleansing composition.

| INGREDIENT | W/W % |
|---|---|
| RO Water | 88.173 |
| Citric acid | 4.000 |
| Ammonium Hydroxide (29.4% ammonia) FCC | 0.730 |
| Sodium Lauryl Sulfate (29% active) | 6.897 |
| White thyme oil (46% thymol) | 0.200 |

In another example, a 2× concentrated cleansing composition was made to have the ingredients listed in Table 2. Briefly, water purified by reverse osmosis was weighed into a tared vessel. The water was heated to 50° C. and agitation was started. Citric acid was added and the solution was agitated until the citric acid was dissolved. Ammonia was added, followed by addition of sodium lauryl sulfate. The solution was mixed well after each addition. Thyme oil was added, and mixing was continued until the solution was completely clear.

TABLE 2

A 2X concentrated cleansing composition.

| INGREDIENT | W/W % |
|---|---|
| RO Water | 87.973 |
| Citric acid | 4.000 |
| Ammonium Hydroxide (29.4% ammonia) FCC | 0.730 |
| Sodium Lauryl Sulfate (29% active) | 6.897 |
| White thyme oil (46% thymol) | 0.400 |

Example 2

Preparation of a 6× Concentrated Cleansing Composition

A 6× concentrated cleansing composition was made to have the ingredients listed in Table 3. Briefly, water and sodium lauryl sulfate were mixed at room temperature. Thymol was added with agitation. The solution was warmed to 40-50° C. Agitation was continued until the thymol dissolved completely. The citric acid and trisodium citrate dihydrate were added, and the composition was agitated until homogenous. The composition was cooled to room temperature.

TABLE 3

A 6X concentrated cleansing composition.

| Constituent | Weight % Composition |
|---|---|
| Water | Balance |
| Sodium lauryl sulfate | 6 |
| Citric acid | 9.6 |
| Trisodium citrate dihydrate | 3.69 |
| Thymol | 0.6 |

In another example, a 6× concentrated cleansing composition was made to have the ingredients listed in Table 4. Briefly, water and sodium lauryl sulfate were mixed at room temperature. Thymol was added with agitation. Sodium hydroxide 50% was added to accelerate the dissolution of the thymol, and the solution was warmed to 40-50° C. Upon dissolution of the thymol, trisodium citrate and citric acid were added and agitation was continued until dissolution was complete. The composition was cooled to room temperature.

TABLE 4

A 6X concentrated cleansing composition.

| Constituent | Weight % Composition |
|---|---|
| Water | Balance |
| Sodium lauryl sulfate | 6 |
| Citric acid | 10.08 |
| Trisodium citrate dihydrate | 2.94 |
| Sodium Hydroxide (50% solution) | 0.60 |
| Thymol | 0.6 |

Example 3

Determination of Tolerance to Hydrolysis of a Cleansing Composition

The potential tolerance to hydrolysis of a composition provided herein can be estimated by preparing the composition and a second composition in which 10 mole percent of the alkyl sulfates are replaced with an equimolar amount of the fatty alcohol from which the alkyl sulfate is derived by sulfation. This second composition represents the effect of 10 mole percent hydrolysis on the composition. For example, the 10% hydrolyzed composition of a composition containing 6.0% sodium lauryl sulfate (FW 288.33 Daltons) contains 5.4% sodium lauryl sulfate and 0.388% lauryl alcohol (FW 186.34 Daltons). The tolerance to hydrolysis of a 10% hydrolyzed composition that forms a homogeneous liquid is greater than 10%.

More commonly, a 10% hydrolyzed composition is not homogeneous as evidenced by cloudiness, separation into different layers, or formation of undissolved suspended or precipitated matter. In this case, the 10% hydrolyzed composition is agitated vigorously to achieve and maintain approximate homogeneity. Samples of the 10% hydrolyzed composition are withdrawn and mixed with the trial composition in varying proportions as shown in Table 5. The highest mole percent hydrolysis sample which remains clear and homogeneous after mixing thoroughly and equilibrating for 24 hours represents the hydrolysis tolerance of the trial composition. In the example shown in Table 5 the hydrolysis tolerance of the trial composition is estimated to be 4.0% although the actual tolerance may lie between 4.0% and 5.0%.

TABLE 5

Determination of the hydrolysis tolerance of a cleansing composition.

| Mole % Hydrolysis | 2.5 | 3.0 | 3.5 | 4.0 | 4.5 | 5.0 |
|---|---|---|---|---|---|---|
| Weight of Trial Composition (MRD Lot#011306-1) (g) | 75 | 70 | 65 | 60 | 55 | 50 |
| Weight of 10% Hydrolyzed Composition (MRD Lot#011306-2 (g) | 25 | 30 | 35 | 40 | 45 | 50 |
| Sample Appearance | Clear, homogeneous | Clear, homogeneous | Clear, homogeneous | Clear, homogeneous | Slightly hazy | Cloudy |

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A liquid cleansing and disinfecting composition in a concentrated form for dilution before use comprising sodium lauryl sulfate, citric acid, ammonium hydroxide, and thyme oil, wherein between 6 and 7 percent by weight, or between 1.5 and 2.5 percent on an active basis, of said liquid cleansing and disinfecting composition comprises said sodium lauryl sulfate, wherein between 3 and 5 percent of said liquid cleansing and disinfecting composition comprises said citric acid by weight, wherein between 0.7 and 0.8 percent, or between 0.2 and 0.23 percent on an ammonia basis, of said liquid cleansing and disinfecting composition comprises said ammonium hydroxide by weight, and wherein between 0.15 and 0.25 percent of said composition comprises said thyme oil by weight, wherein said liquid cleansing and disinfecting composition remains homogeneous for a period of at least 12 months when stored at 20° C. or for a period of at least three months when stored at 40° C.

2. A ready-to-use liquid cleansing and disinfecting composition comprising sodium lauryl sulfate, citric acid, ammonium hydroxide, and thyme oil, wherein between 3 and 3.5 percent by weight, or between 0.75 and 1.25 percent on an active basis, of said ready-to-use liquid cleansing and disinfecting composition comprises said sodium lauryl sulfate, wherein between 1.5 and 2.5 percent of said ready-to-use liquid cleansing and disinfecting composition comprises said citric acid by weight, wherein between 0.35 and 0.4 percent, or between 0.1 and 0.12 percent on an ammonia basis, of said ready-to-use liquid cleansing and disinfecting composition comprises said ammonium hydroxide by weight, and wherein between 0.075 and 0.125 percent of said ready-to-use liquid cleansing and disinfecting composition comprises said thyme oil by weight, wherein said ready-to-use liquid cleansing and disinfecting composition remains homogeneous for a period of at least 12 months when stored at 20° C. or for a period of at least three months when stored at 40° C.

3. A liquid cleansing and disinfecting composition in a concentrated form for dilution before use comprising sodium lauryl sulfate, citric acid, trisodium citrate dihydrate, and thymol, wherein between 5 and 7 percent of said liquid cleansing and disinfecting composition comprises said sodium lauryl sulfate by weight, wherein between 9 and 10 percent of said liquid cleansing and disinfecting composition comprises said citric acid by weight, wherein between 4 and 5 percent of said liquid cleansing and disinfecting composition comprises said trisodium citrate dihydrate by weight, and wherein between 0.5 and 1 percent of said liquid cleansing and disinfecting composition comprises said thymol by weight, wherein said liquid cleansing and disinfecting composition remains homogeneous for a period of at least 12 months when stored at 20° C. or for a period of at least three months when stored at 40° C.

4. A ready-to-use liquid cleansing and disinfecting composition comprising sodium lauryl sulfate, citric acid, trisodium citrate dihydrate, and thymol, wherein between 0.8 and 1.2 percent of said ready-to-use liquid cleansing and disinfecting composition comprises said sodium lauryl sulfate by weight, wherein between 1 and 2 percent of said ready-to-use liquid cleansing and disinfecting composition comprises said citric acid by weight, wherein between 0.5 to 0.7 percent of said ready-to-use liquid cleansing and disinfecting composition comprises said trisodium citrate dihydrate by weight, and wherein between 0.04 to 0.06 percent of said ready-to-use liquid cleansing and disinfecting composition comprises said thymol by weight, wherein said ready-to-use liquid cleansing and disinfecting composition remains homogeneous for a period of at least 12 months when stored at 20° C. or for a period of at least three months when stored at 40° C.

* * * * *

UNITED STATES PATENT AND TRADEMARK OFFICE

CERTIFICATE OF CORRECTION

PATENT NO. : 7,642,227 B2
APPLICATION NO. : 11/462952
DATED : January 5, 2010
INVENTOR(S) : James L. Kurtz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 652 days.

Signed and Sealed this

Sixteenth Day of November, 2010

David J. Kappos

David J. Kappos
*Director of the United States Patent and Trademark Office*